US005634570A

United States Patent [19]

Casper et al.

[11] Patent Number: 5,634,570

[45] Date of Patent: Jun. 3, 1997

[54] DISPENSER FOR LINERLESS LABELS

[75] Inventors: Mark Casper; Stephen Michalovic, both of Williamsville, N.Y.

[73] Assignee: Moore Business Forms, Inc., Grand Island, N.Y.

[21] Appl. No.: 411,518

[22] Filed: Mar. 28, 1995

[51] Int. Cl.[6] ..... B65H 5/28

[52] U.S. Cl. ..... 221/73; 221/70; 221/71; 206/408; 206/416; 206/395

[58] Field of Search ..... 221/305, 312 C, 221/303, 70, 71, 73; 206/407, 408, 415, 416, 395, 396, 397

[56] References Cited

U.S. PATENT DOCUMENTS

| | | | |
|---|---|---|---|
| 2,700,463 | 1/1955 | McCormick | 206/397 |
| 3,190,517 | 6/1965 | Rice | 206/408 X |
| 3,613,973 | 10/1971 | Jaeschke | 206/408 X |
| 4,162,739 | 7/1979 | Nelson | 221/70 |
| 4,570,794 | 2/1986 | Capitao | 206/407 X |
| 5,024,349 | 6/1991 | Haenni et al. | 221/312 C X |
| 5,133,980 | 7/1992 | Ream et al. | 426/5 X |
| 5,141,108 | 8/1992 | Roccaforte | 206/396 |
| 5,364,045 | 11/1994 | Clayton et al. | 221/70 X |
| 5,397,117 | 3/1995 | Mertens | 221/70 |
| 5,401,547 | 3/1995 | Blackwell et al. | 221/45 |
| 5,518,144 | 5/1996 | Samuelson et al. | 221/33 |

FOREIGN PATENT DOCUMENTS

| | | | |
|---|---|---|---|
| 9324394 | 12/1993 | WIPO | 206/407 X |

*Primary Examiner*—William E. Terrell
*Assistant Examiner*—Khoi H. Tran
*Attorney, Agent, or Firm*—Nixon & Vanderhye P.C.

[57] ABSTRACT

An inexpensive material dispenser for a roll or rolls of linerless labels may be in tube form, or constructed from a folded sheet blank. The tube may be removably closed at one or both ends and have an exterior peripheral surface with at least a portion of adhesive release material. A roll of linerless labels is loose in the tube interior and dispensed through an opening in the peripheral surface. A cardboard or paperboard blank may be folded so that end tabs are received within (having an interference fit with) a roll core, or a core for a plurality of label rolls. The labels of the plurality of rolls are prevented from touching each other.

12 Claims, 2 Drawing Sheets

FIG.1
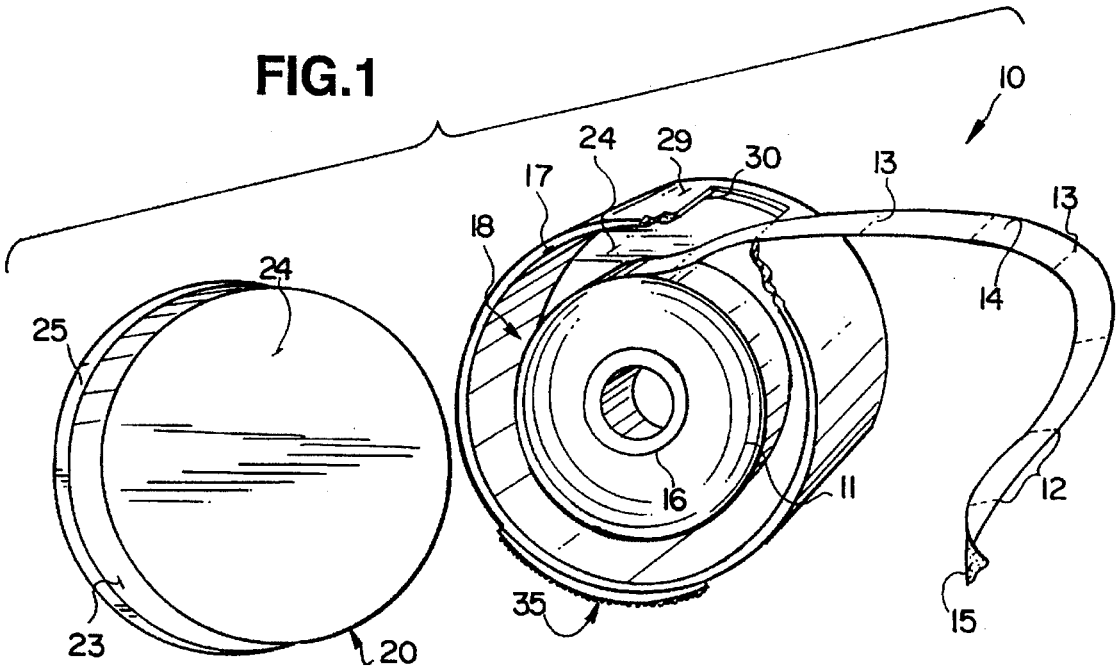
FIG. 2
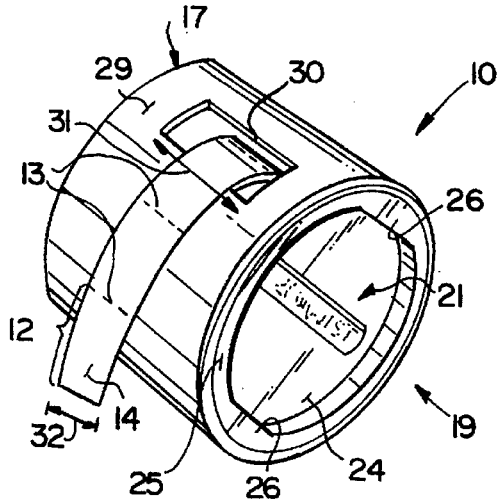
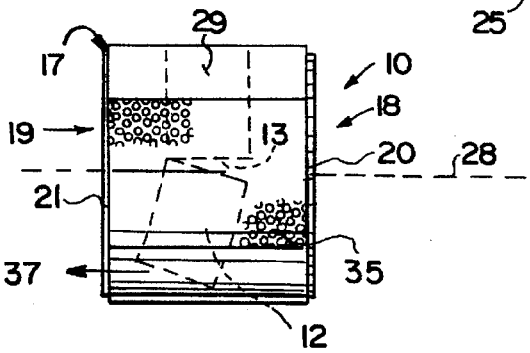
FIG. 3

DISPENSER FOR LINERLESS LABELS

BACKGROUND AND SUMMARY OF THE INVENTION

Because of environmental and other advantages, linerless labels are becoming increasingly more popular. However even for limited use applications it is convenient to use a dispenser for dispensing linerless labels so that the lead edge of each of the labels can, in turn, easily be found to facilitate ready detachment and use of the labels. While a number of good industrial dispensers exist for linerless labels, there are many users or potential users that would like to have the advantages of a dispenser but cannot cost justify an industrial dispenser because of limited usage, or the like.

According to the present invention a dispenser particularly suited for linerless labels is provided which is extremely low cost, easy to produce, assemble, and utilize, yet effectively dispenses linerless labels. The materials of which the dispenser according to the invention are constructed are extremely inexpensive, and readily available and the dispenser according to the invention is so inexpensive that it may be used simply to dispense a single roll of linerless labels (or a number of rolls at one time) and then discarded. However it does have sufficient integrity that if desired it can be used to dispense a number of rolls of linerless labels in sequence, it being a simple and easy procedure to remove the core of a dispensed roll and substitute a new roll.

According to one aspect of the present invention a linerless label dispenser is provided for dispensing linerless labels having a first surface of adhesive release material, and a second surface having pressure sensitive adhesive. The dispenser comprises: A tube having an inside diameter larger than the outside diameter of a roll of linerless labels, and an exterior peripheral surface concentric with an axis of the tube. An opening formed in the exterior peripheral surface elongated in a dimension parallel to the tube axis, and large enough for a linerless label to pass therethrough without substantial deformation of the label. And at least a portion of the exterior peripheral surface of a release material which will not permanently adhere to the adhesive of the second surface of the linerless labels.

The at least a portion of the exterior peripheral surface preferably comprises a raised irregular surface of release material or having a release material coating, such as a rubberized coating. The tube typically has at least one open end, and preferably open first and second ends, with a removable tab removably closing each of the open ends. The tube is preferably made of cardboard or paperboard, although plastic (e.g. polycarbonate) may also be used, and the elongated opening is typically quadrate in shape. The entire (or substantially the entire) exterior peripheral surface may have a smooth release material coating, with the irregular surface located substantially opposite the elongated opening.

The invention also comprises a cardboard, paperboard, or plastic tube suitable for use as a linerless label dispenser, the tube having an axis of elongation, an exterior peripheral surface, first and second open ends; a substantially quadrate slot formed in the tube and elongated in a dimension parallel to the axis; and an adhesive-release material covering at least part of the exterior peripheral surface.

According to another aspect of the invention a linerless label dispenser assembly is provided comprising the following components: An integral sheet having first and second ends and a plurality of fold lines parallel to each other, the fold lines defining a center section having an outer surface. First and second tabs formed adjacent the first and second ends of the integral sheet, the tabs each having a predetermined width extending in a dimension parallel to the score lines. At least one roll of linerless labels mounted on a core having a first interior diameter, the labels each having a first surface of release material, and a second surface covered with pressure sensitive adhesive. The tabs disposed within the core interior diameter and a release material covering at least a part of the center section.

Preferably the predetermined width of the tabs is slightly greater than the first interior diameter so that the tabs make an interference fit with the first interior diameter. The integral sheet is preferably of cardboard or paperboard, and the core preferably has a plurality of rolls of linerless labels thereon, although it can have only one roll; where a plurality of rolls are provided core portions prevent them from touching each other. The release material covering at least part of the center section may comprise one or more of the linerless labels with the label adhesive in contact with the center section. The center section also preferably has a label detachment-facilitating edge parallel to the core and a second edge parallel to the label detachment-facilitating edge.

According to still another aspect of the present invention a blank for constructing a linerless label dispenser is provided. The blank comprises the following components: An integral sheet of cardboard or paperboard having first and second ends. First through fourth fold lines parallel to each other, the fourth and third fold lines defining a center section between them, the first fold line and first end forming a first tab, and the second fold line and the second end forming a second tab. Each of the tabs has first and second free side edges spaced from each other a first distance that is approximately the same as the interior diameter of a core of a roll of linerless labels. And the center section has first and second substantially parallel free side edges spaced from each other a second distance which is greater than the first distance, and is at least equal to the width of a linerless label.

The blank preferably also further comprises first and second transition sections defined by first and second fold lines, and third and fourth fold lines, respectively, the transition sections having the side edges which gradually taper from the center section to a tab. The center section has outer and inner faces, and further comprises linerless label adhesive release material covering at least a portion of the outer surface of the center section.

It is the primary object of the present invention to provide for the simple, cost effective, and properly functioning dispensing of linerless labels. This and other objects of the invention will become clear from an inspection of the detailed description of the invention and from the appended claims.

BRIEF DESCRIPTION OF THE DRAWINGS

FIG. 1 is a first, exploded perspective view, with portions cut away for clarity of illustration, of an exemplary first embodiment of a linerless label dispenser according to the invention with one end cap removed and with a roll of linerless labels in the dispenser;

FIG. 2 is a top perspective view of the dispenser of FIG. 1 when assembled, and with a strand of labels shown being pulled out from the dispenser;

FIG. 3 is an end view of the assembled dispenser of FIGS. 1 and 2;

DETAILED DESCRIPTION OF THE DRAWINGS

Figure 4:
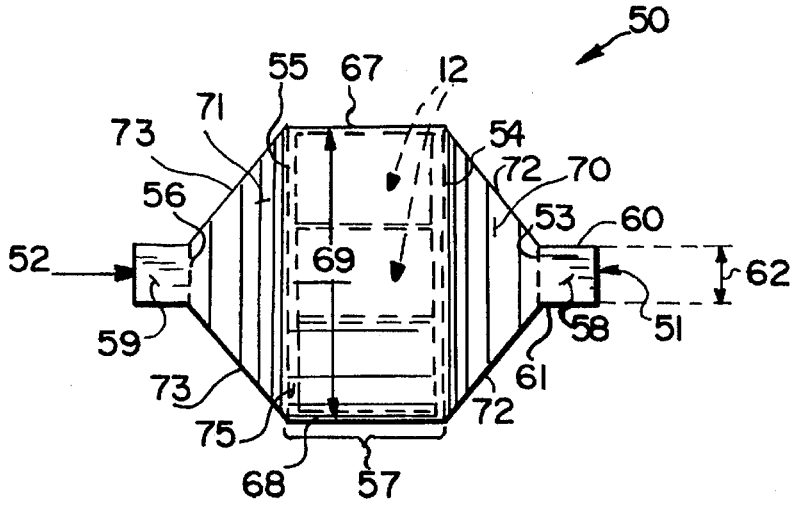
FIG. 4 is a top plan view of a blank of a second embodiment of a linerless label dispenser according to the invention.

The first embodiment of a linerless label dispenser is shown generally at reference numeral 10 in FIGURES 1 through 3. The dispenser 10 for dispensing linerless labels from a roll 11 typically has an interior hollow cardboard core 16. The individual linerless labels 12 preferably are separated by lines of weakness 13 (such as die cuts, perforations, or the like). Alternatively, the labels 12 may be provided without lines of weakness and are simply torn from the dispenser 10 by pulling the label material 12 against the edge of the opening 30. In this way, the user may dispense varying amounts of label material to suit his or her particular need. The labels 12 have a first surface 14 of an adhesive release material, such as silicone, and a second surface 15 (see FIG. 1) having pressure sensitive adhesive, which may be either permanent, removable, or repositional adhesive. When in the roll configuration 11 the pressure sensitive adhesive second surface 15 of each label 12 engages the release material 14 of other labels 12 in the roll 11.

The dispenser 10 comprises a tube 17 which is of an inexpensive material. Preferably the tube 17 is of paperboard or cardboard (e.g., having a weight of about 1.0–1.4 pounds per 1000 square inches), although it may alternatively be made of an inexpensive plastic material such as polycarbonate (e.g. such as that manufactured by ATO Haas of Philadelphia, Pa., which polycarbonate is particularly ductile and easily thermo-formed). The tube 17 has first and second ends 18, 19. While only one of the ends 18, 19 would need be open, preferably both ends 18, 19 are open and are removably closed by plastic end caps 20, 21, respectively. Each of the end caps 20, 21 includes a substantially cylindrical portion 23 (see FIG. 1) having an external diameter approximately the same as the internal diameter of the tube 17 to make an interference fit therewith, and a generally solid end face 24. The lip 25 has a diameter larger than that of the cylindrical portion 23, and preferably is approximately the same as the external diameter of the tube 17. As seen in FIG. 2, one or more ridges 26 (preferably two ridges 26) may be provided at opposite portions of the lip 25 to allow ready grasping of the end caps 20, 21 to allow detachment from the tube 17, as illustrated for the end cap 20 in FIG. 1.

As seen in FIG. 3, the tube 17 has an axis 28, and has an exterior peripheral surface 29. The surface 29 has at least one opening 30 (see FIGS. 1 and 2) formed therein, the opening 30 being elongated in a dimension 31 parallel to the tube axis 28, and large enough for a linerless label 12 to pass therethrough without substantial deformation of the label 12. The opening 30 may in fact be two or more multiples of the width 32 of a label 12. That is, a dispenser 10 may include—instead of just one roll 11 as illustrated in FIG. 1, two or more rolls 11 placed side by side with the labels 12 thereof each passing through the opening 30, of course depending upon the length (the dimension along the axis 28) of the dispenser 10, and the width 32 of the labels 12.

At least a portion of the exterior surface 29 is of a release material which will not permanently adhere to the pressure sensitive adhesive 15 of the second surface of the linerless labels 12. For example, substantially the entire peripheral surface 29 may be of a smooth and low adhesive adherence surface, for example, a silicone release material either directly applied to the cardboard or paperboard of the tube 17, or on a piece of tape opposite an adhesive surface which adheres to the cardboard or paperboard of the tube 17.

The at least a portion of the exterior peripheral surface 29, regardless of the nature of the majority of the surface 29, preferably comprises a raised irregular surface 35 of release material, or having a release material coating. For example, the surface 35 may comprise a piece of elastomeric material such as synthetic rubber and having a plurality of adjacent raised cylinders or nubs which—due to the elastomeric nature of the material are inherently of low adhesive-adherence material—or the irregular surface may be coated with a release material such as silicone. In fact the raised irregular surface 35 may be a piece of elastomeric "tape" with an adhesive opposite the irregular surface 35 and the adhesive secured to the external periphery 29 of the tube 17.

As seen in FIGURES 1 and 3, the raised irregular surface 35 preferably is opposite (or substantially opposite) the elongated opening 30. FIG. 3 illustrates an exemplary manner in which linerless labels are readily dispensed by the dispenser 10. The leading label 12 is moved around the exterior peripheral surface 29 until the line of weakness 13 thereof overlies the surface 35. Because the surface 35 is irregular, the adhesive 15 of the leading label 12 will adhere somewhat thereto, enough for the label 12 to be detached by a force applied in the direction 37 (see FIG. 3). The next label 12, however, readily releases from the surface 35, and because the surface 35 is raised and the surface 29 is constructed of a low adherence material, the next label 12 may readily be detached and advanced.

Figure 5:
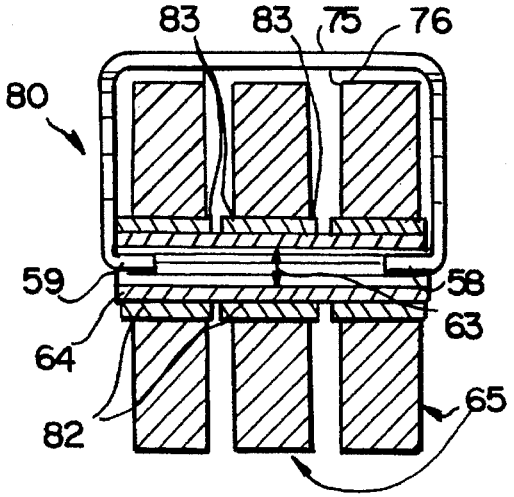
FIG. 5 is an end view, partly in cross section and partly in elevation, of a dispenser made from the blank of FIG. 4 in association with a plurality of rolls of linerless labels.
Figure 6:
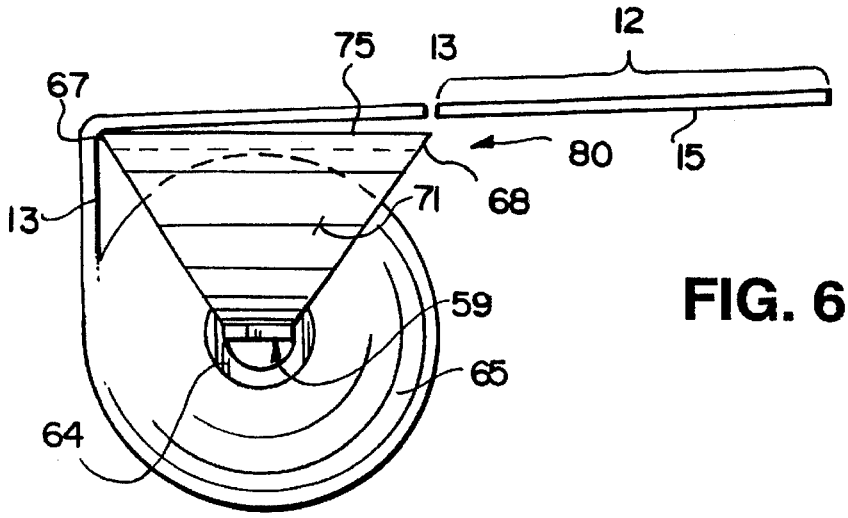
FIG. 6 is a side view of the dispenser label assembly of FIG. 5 showing an exemplary manner in which the labels are dispensed thereby.

FIGS. 4 through 6 illustrate a second embodiment of the dispenser and dispenser assembly according to the present invention. FIG. 4 illustrates a blank 50 comprising an integral sheet of cardboard or paperboard having substantially the same weight as (or slightly less than) the tube 17 and having first and second ends 51, 52. At least first through fourth fold lines 53 through 56, respectively, are provided, which may comprise crease lines, score lines, perforations, or the like. The fold lines 53 through 56 facilitate folding of the blank 50 thereabout. The second and third fold lines 54, 55 define a center section 57 between them, the first fold line 53 and the first end 51 define a first tab 58, while the fourth fold line 56 and second end 52 define a second tab 59.

Each of the tabs 58, 59 has first and second side edges 60, 61, respectively, that are spaced from each other a first distance 62 which is approximately the same as the interior diameter 63 (see FIG. 5) of a core 64 of a roll 65 of linerless labels. The linerless labels of the roll 65 are substantially the same as those illustrated in the FIGS. 1 through 3 embodiment, and are shown by the same reference numeral (12), having lines of weakness 13 between them, a release material first surface 14, and pressure sensitive adhesive second surface 15. Preferably, the side edges 60, 61 are substantially parallel to each other, although they may be slightly tapered inwardly from the fold lines 53, 56, respectively, to the ends 51, 52, respectively. The center section 57 also has first and second ends 67, 68 which are substantially parallel to each other and spaced a second distance 69 which is at least equal to the width 32 of the linerless labels 12. In the embodiment illustrated in FIGS. 4 through 6, the second distance 69 is greater than the widths of three linerless labels 12.

While a wide variety of other structures could be provided, in order to provide an aesthetic appearance while at the same time using a minimum amount of material, first and second transition sections 70, 71 between the fold lines 53, 54 and 55, 56, respectively, are preferably trapezoidal in shape, having side edges 72, 73, respectively, which gradually taper from the center section 57 to the tabs 58, 59.

The center section 57 also preferably has an outer surface 75 and an inner surface (see FIG. 5) 76. The outer surface 75 preferably is of, or has a coating of, an adhesive-release material, such as silicone. The release material may be provided by one or more labels 12—as illustrated in dotted line in FIG. 4.

In use, the blank 50 is folded about the fold lines 53–56 to provide a dispenser 80 illustrated in FIGS. 5 and 6, the tabs 58, 59 making an interference fit with the core 64 interior diameter 63 to form the blank 50, core 64, and roll or rolls 65 as a unit. The center section 57 has label detachment-facilitating edges 68, 67 (free side edges of the center section 57) which preferably are merely the cardboard or paperboard of the blank 50, but may include (on one or both edges 68, 67), metal or plastic reinforcements, blades, or the like, to facilitate detachment at the lines of weakness 13, as illustrated in FIG. 6. The dimension 69 is preferably not exactly the same as the length of the label 12 so that it is not possible that perforations or lines of weakness 13 will be in alignment with both edges 68, 67 at the same time.

While in the FIG. 5 illustration a plurality of rolls 65 of linerless labels are shown, each having its own individual core 82 which are on the common core 64, different arrangements may be provided. For example, a single roll 65 may be provided having the core 82 thereof serving as the core 64, or instead of the tabs 58, 59 spaced from each other, they may be elongated so that they may be secured together within the interior diameter 65, in which case they may or may not provide an interference fit.

When a plurality of label tells are used in a dispenser, as for the rolls 65 illustrated in FIG. 5, if the rolls are side by side the adhesive on the edge of the labels of each roll tends to stick to the adjacent label roll. This causes adjacent rolls to begin moving, potentially dispensing multiple labels instead of a single label. This is prevented according to the present invention by providing the cores 82 so that they have portions 83 thereof which extend beyond (parallel to the axis of rotation) each roll 65 of label material to prevent the label rolls 65 themselves from coming into contact with each other, and sticking. This allows individual labels 12 to be readily dispensed from each of the rolls 65 without adversely affecting the other rolls.

In both of the embodiments of FIGS. 1 through 3, and FIGS. 4 through 6, the dispensers 10, 80, are inexpensive and simple to make and utilize, and provide effective dispensing of linerless labels. The dispensers 10, 80 are inexpensive enough that they can only be used one or a few times, or they may be used a plurality of times.

While the invention has been herein shown in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A cardboard or paperboard tube suitable for use as a linerless label dispenser, said tube having an axis of elongation, an exterior peripheral surface, first and second open ends; a substantially quadrate slot formed in said tube and elongated in a dimension parallel to said axis; and an adhesive-release material covering at least part of said exterior peripheral surface.

2. A linerless label dispenser assembly comprising:

an integral sheet having first and second ends and a plurality of fold lines parallel to each other, said fold lines defining a center section having an outer surface;

first and second tabs formed adjacent said first and second ends of said integral sheet, said tabs each having a predetermined width extending in a dimension parallel to said fold lines;

at least one roll of linerless labels mounted on a core having a first interior diameter, said labels each having a first surface of release material, and a second surface covered with pressure sensitive adhesive;

said tabs disposed within said core interior diameter; and a release material covering at least a part of said center section.

3. A linerless label dispenser assembly as recited in claim 2 wherein said predetermined width of said tabs is slightly greater than said first interior diameter so that said tabs make an interference fit with said first interior diameter.

4. A linerless label dispenser assembly as recited in claim 3 wherein said integral sheet is of cardboard or paperboard.

5. A linerless label dispenser assembly as recited in claim 4 wherein said core has a plurality of rolls of linerless labels thereon, each roll having a core portion extending outwardly from the linerless labels of the roll to prevent the labels of the rolls from coming into contact with each other.

6. A linerless label dispenser assembly as recited in claim 2 wherein said release material covering at least part of said center section comprises one or more of said linerless labels with said label adhesive in contact with said center section.

7. A linerless label dispenser assembly as recited in claim 4 wherein said center section has a label detachment-facilitating edge parallel to said core.

8. A linerless label dispenser assembly as recited in claim 7 wherein said center section comprises a second edge parallel to said label detachment-facilitating edge.

9. A blank for constructing a linerless label dispenser, comprising:

an integral sheet of cardboard or paperboard having first and second free ends;

first through fourth fold lines parallel to each other, said second and third fold lines defining a center section between them, said first fold line and first free end forming a first tab, and said fourth fold line and said second free end forming a second tab;

each of said tabs having first and second free side edges spaced from each other a first distance that is approximately the same as the interior diameter of a core of a roll of linerless labels; and said center section having first and second substantially parallel free side edges spaced from each other a second distance which is greater than said first distance, and is at least equal to the width of a linerless label.

10. A blank as recited in claim 9 further comprising first and second transition sections defined by said first and second fold lines, and third and fourth fold lines, respectively, said transition sections having side edges which gradually taper from said center section to a said tab.

11. A blank as recited in claim 9 wherein said center section has outer and inner faces; and further comprising linerless label adhesive release material covering at least a portion of said outer surface of said center section.

12. A linerless label dispenser, for dispensing linerless labels having a first surface of adhesive release material, and a second surface having pressure sensitive adhesive, said dispenser comprising:

a tube having an inside diameter larger than the outside diameter of a roll of linerless labels, and an exterior peripheral surface concentric with an axis of said tube;

an opening formed in said exterior peripheral surface elongated in a dimension parallel to said tube axis, and large enough for a linerless label to pass therethrough without substantial deformation of the label; and at least a portion of said exterior peripheral surface of a release material which will not permanently adhere to the adhesive of the second surface of the linerless labels, including a raised irregular surface, located substantially opposite said elongated opening, of release material or having a release material coating.

* * * * *